United States Patent [19]

Faria et al.

[11] 4,239,844

[45] Dec. 16, 1980

[54] ELECTROPHOTOCONDUCTIVE CD S SE MATERIALS WITH CU AND CL

[75] Inventors: Sixdeniel Faria; Vincent Chiola, both of Towanda, Pa.

[73] Assignee: GTE Products Corporation, Stamford, Conn.

[21] Appl. No.: 17,517

[22] Filed: Mar. 5, 1979

Related U.S. Application Data

[63] Continuation of Ser. No. 779,069, Mar. 18, 1977, abandoned, which is a continuation of Ser. No. 706,625, Jul. 19, 1976, abandoned, which is a continuation of Ser. No. 577,539, May 14, 1975, abandoned, which is a continuation-in-part of Ser. No. 476,694, Jun. 5, 1974, abandoned.

[51] Int. Cl.[3] ..... G03G 5/08

[52] U.S. Cl. ..... 430/67; 430/94; 430/95; 252/501.1; 423/508; 423/518

[58] Field of Search ..... 96/1.5 R, 1.5 N; 252/501, 501.1; 423/99, 508, 518; 430/67, 94, 95

[56] References Cited

U.S. PATENT DOCUMENTS

| | | | |
|---|---|---|---|
| 2,866,878 | 12/1958 | Briggs et al. | 252/501 X |
| 2,958,932 | 11/1960 | Goercke | 252/501 X |
| 3,142,586 | 7/1964 | Colman | 252/501 X |
| 3,492,718 | 2/1970 | Nakamura et al. | 252/501 X |
| 3,565,686 | 2/1971 | Babcock et al. | 252/501 X |
| 3,647,430 | 3/1972 | Hanada et al. | 96/1.5 |
| 3,743,609 | 7/1973 | Hirata et al. | 252/501 |
| 3,948,656 | 4/1976 | Maxwell | 96/1.5 |
| 3,975,306 | 8/1976 | Jones et al. | 423/508 X |

OTHER PUBLICATIONS

Yamanaka et al., "Photoconductive Properties of $Cd(S_xSe_{(1-y)})$ Crystals," *Qyo Buturi,* 1963, pp. 98–102.

*Primary Examiner*—Roland E. Martin, Jr.
*Attorney, Agent, or Firm*—John C. Fox

[57] ABSTRACT

An electrophotoconductive material having the molecular formula:

$Cd(S_xSe_{1-x})$:yCu.zCl is improved by controlling x in the range of from about 0.95 to about 0.98, y from about 0.0001 to about 0.001 and z is from about 0.001 to about 0.0015. The materials also have a relatively narrow particle size distribution and a relatively fine particle size and the surfaces relatively free of p-type copper sulfide. The improved materials exhibit and maintain a large differential between the image voltage and the background voltage of in excess of 800 volts when the material is used as an electrophotoconductive layer in a photosensitive member of equipment used in electrophotograhic copying processes. The photosensitive member consisting essentially of a conductive base, and electrophotoconductive layer of from about 40 to 60 micrometers overlaying the base consisting of the foregoing electrophotoconductive material and an insulating layer of from about 20 to 40 micrometers overlaying the electrophotoconductive layer exhibits improved contrast properties and a longer life than prior art members when used in an electrophotographic reproduction process.

1 Claim, 3 Drawing Figures

ELECTROPHOTOCONDUCTIVE CD S SE MATERIALS WITH CU AND CL

CROSS REFERENCE TO RELATED APPLICATION

This application is a Continuation of Ser. No. 779,069, filed Mar. 18, 1977 which was a continuation of Ser. No. 706,625 filed July 19, 1976, now abandoned which was a continuation of Ser. No. 577,539, filed May 14, 1975, now abandoned, which was a continuation-in-part of Ser. No. 476,694, filed June 5, 1974, now abandoned.

BACKGROUND OF THE INVENTION

1. Field of the Invention

This invention relates to improved electrophotoconductive materials and photosensitive members utilizing the electrophotoconductive materials. More particularly, it relates to an improved cadmium sulfo-selenide host activated with copper and chlorine having controlled levels of selenium and chloride, a small particle size and a narrow particle size distribution and the surfaces free of p-type copper sulfide which enables improved contrast when such material is employed as an electrophotoconductor in equipment utilized in an electrophotographic reproduction process.

2. Prior Art

Photoconductive materials are known and have a variety of uses in photoelectric devices, photoelectric relay devices and the like. Electrophotoconductive materials useful in electrophotographic process and apparatus, while of the same generic type of material have to have different properties. A small particle size material is usually required in electrophotographic application; normally from 1 to 2 micrometers. The small particle size material has a high response to visible light excitation, while other electrophotographic materials have their highest response in the ultraviolet, for example Se and ZnO. While neither Se nor ZnO to be activated with other elements, CdS and Cd(S,Se) are usually activated with copper or silver in order to enhance their photo response.

Prior art electrophotoconductive materials are disclosed in a number of sources. For example, U.S. Pat. No. 3,666,363 discloses a mixture of CdS and a ternary compound of the formula $X_4YZ_6$ wherein X is Zn or Cd, Y is Si or Ge and Z is S, Se and Te. Such a mixture is used for color reproduction.

U.S. Pat. No. 3,743,609 discloses a process for firing mixtures of cadmium sulfide, cadmium selenide or cadmium sulfoselenide in the presence of a suitable activator, a flux and a dispersant. The foregoing process provides a material which has a fine particle size, however, the material tends to degrade when used in electrophotographic processes and does not exhibit a high differential between the image voltage and the background voltage. While such materials are suitable for copying black and white materials the contrast is not sufficient to enable a clear copy over a long period of time. Additionally, one of the major difficulties with the present day copiers is the reproduction in black and white of documents that contain color. Although color reproductions can be made by other processes, e.g., photographic process, often in many instances it is desirable to make a black and white copy of information contained in color display on the original (for example, graphs and certain printings displayed in color on the original for certain effects). Another problem that sometimes exists is that original copies do not always have a good contrast. With present materials, an unclear copy can result because the differential between the image and background voltage, hereinafter referred to as contrast voltage, is not great enough to enable sufficient contrast between the printing on the paper and the paper color. Additionally, the prior art materials tended to degrade and the photosensitive members which contain a base of a conductive material, an electrophotoconductive layer overlying the conductive base and an insulating layer overlying the electro-photoconductive layer, had to be replaced after the electrophotographic process was used to run several copies.

It is believed, therefore, that an electrophotoconductive material which has a desired particle size and narrow particle size distribution, exhibits a large contrast voltage and which does not degrade even after upon prolonged usage would be an advancement in the art.

OBJECTS AND SUMMARY OF THE INVENTION

It is an object of this invention to provide an improved electrophotoconductive material of the cadmium sulfo-selenide type.

It is an additional object of this invention to provide a photosensitive member which has a longer life than prior art photosensitive members.

It is a further object of this invention to provide an improved process for producing electrophotoconductive materials.

It is a further object of this invention to provide a process for producing electrophotoconductive materials of the cadmium sulfide-selenide type which have improved electrophotographic properties.

These and other objects of the invention can be achieved by one aspect of this invention by photosensitive photoconductive materials of the formula:

$$Cd(S_xSe_{1-x}):yCu \bullet zCl$$

wherein x is from about 0.95 to about 0.98, y is from about 0.0001 to about 0.001 and z is from about 0.001 to about 0.0015, having a relatively narrow particle size distribution and a relatively fine particle size and its surface free of p-type $Cu_2S$ is capable of initially exhibiting and maintaining a large differential between the image voltage and the background voltage when the material is used as an electrophotoconductive layer in a photosensitive member of equipment used in electrophotographic copying processes.

An additional aspect of this invention is a photosensitive member consisting essentially of a conductive base and overlying the conductive base, an electrophotoconductive layer having a thickness of from about 40 to about 60 micrometers consisting essentially of the foregoing cadmium sulfo-selenide materials activated with copper and chlorine and an insulative layer overlying said electrophotoconductive layer having a thickness of from about 20 to about 40 micrometers.

DETAILED DESCRIPTION OF THE PREFERRED EMBODIMENTS

Figure 1:
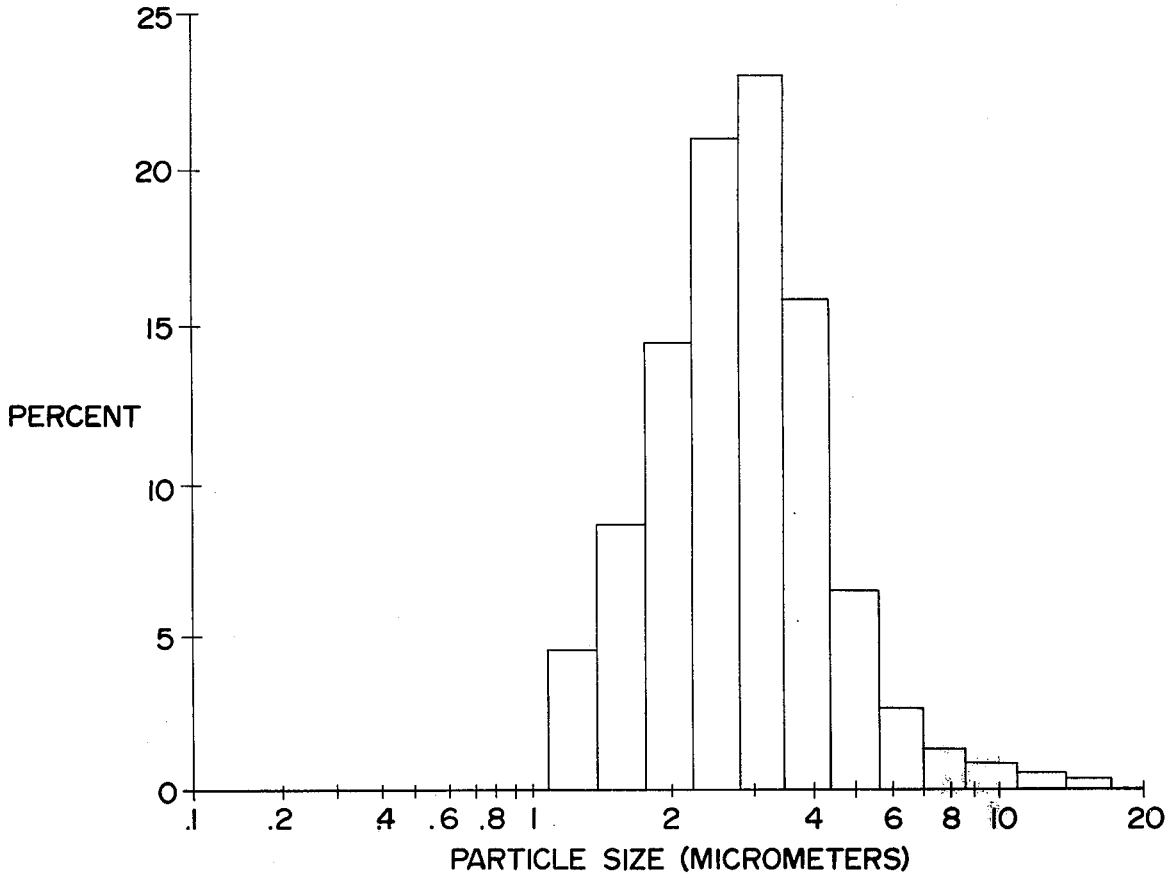
FIG. 1 is the particle size distribution of a typical photoconductive material of this invention as measured by the Coulter Counter method.
Figure 2:
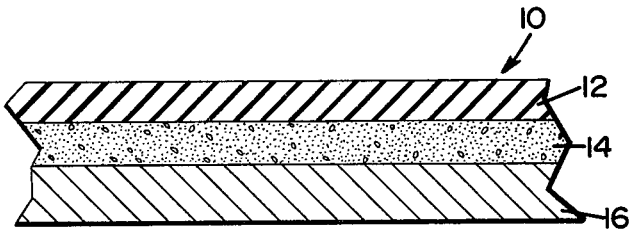
FIG. 2 is a cross-sectional view of a typical photosensitive member of this invention.

For a better understanding of the present invention, together with other and further objects, advantages and capabilities thereof, reference is made to the following disclosure and appended claims in connection with the above-described drawings.

Processes for producing cadmium sulfide are well known. The photoconductive properties of cadmium sulfide are usually obtained by activating it with metals like copper and/or silver. Copper-activated cadmium sulfide prepared by the normally known processes may not be useful in electrophotographic application. One reason is that normally prepared cadmium sulfide is rather large in particle size while electrophotoconductive cadmium sulfide is generally more efficient when greater than about 95%. of the particles are in the 1 to 5 micrometer particle size range as measured by the Coulter Counter method. Most reported particle sizes are average particle size generally measured by Fisher Sub-Sieve Sizer which does not give a particle size distribution in contrast to the Coulter Counter method. Generally the average particle size by FSSS is a smaller number numerically than by the Coulter Counter method. Further information can be obtained for each technique from the references cited on pages 322 and 323, Volume 18 of *Kirk-Othmer Encyclopedia of Chemical Technology*, 2nd Edition, Interscience Publishers, New York, 1969. There are several methods of preparing small particle size material. One method is described in our co-pending application, Ser. No. 386,943, filed Aug. 9, 1973, now abandoned where the large size cadmium sulfide is milled in a controlled manner to yield particles between 1 and 2 microns. However, this milling process in some instances can degrade the photosensitive properties of the material and a subsequent activating step is generally necessary to regain the sensitivity while avoiding a granular growth.

Another process for making electrophotographic cadmium sulfide requires that both he cadmium and the required amount of copper be precipitated, homogeneously, as the sulfides in quantitative yields and be of rather high purity.

Preferably, however, the materials of this invention are made by the process disclosed and claimed in the parent application previously mentioned, Ser. No. 476,694, now abandoned detailed below.

Additionally, the copper activated-cadmium sulfide can be prepared by flowing a stream of hydrogen sulfide over a receptacle containing a cadmium-copper salt. The amount of copper present in the cadmium salt can vary from about 50 to about 500 parts per million by weight but preferably from about 150 to about 300 parts per million by weight based on the weight of the cadmium salt. A solution of a copper salt is dissolved in a solution of cadmium chloride, cadmium sulfate or cadmium nitrate and evaporated to dryness, ground to a fine powder and then fired in an atmosphere of hydrogen sulfide. The activation in this rather high flux concentration takes place at temperatures as low as 180° C., however, it is usually carried out at higher temperatures preferably around 250° C. to 370° C. in order to obtain an average particle size of up to about 3.2 micrometers and about 95% having a particle size between 1 and 5 micrometers. The particle size, of course, varies with both firing temperature and firing time.

The copper-activated cadmium sulfide is then blended with from about 1 to about 20% by weight of cadmium selenide, from about 1 to about 10% by weight of cadmium chloride (anhydrous) and with 0.5 to about 5% of sulfur. The blend is fired in an inert atmosphere at about 400° to 600° C. for 0.5 to about 3 hours. The material is removed and allowed to cool in the inert atmosphere. The level of chloride is preferably controlled to within 0.001 and 0.0015 moles per mole of cadmium sulfide-selenide. Use of larger or lesser amounts result in contrast voltages less than 700 volts.

An essential step is the washing procedure that follows the firing. The fired material is usually suspended in hot water and wet sieved through 300–500 mesh screen. The wet sieved material is then washed with about 0.5 to about 5% potassium cyanide solution to remove excess copper sulfide from the surface. Any water soluble cyanide salt can be used. The next hot water wash allows a larger amount of fine CdS (usually not well activated) to remain suspended and therefore easily decanted. Several hot water washes are conducted to decrease the conductivity of the supernatant liquid. The foregoing washing procedure removes the p-type $Cu_2S$ which is formed on the surfaces of the n-type Cd(S,Se).

To more fully illustrate the subject invention, the following detailed examples are presented. All parts, proportions and percentages are by weight unless otherwise indicated.

EXAMPLE I 175 parts of copper-coprecipitated cadmium sulfide is blended with 10 parts of luminescent grade cadmium selenide, 10 parts of anhydrous cadmium chloride and 5 parts of sulfur. The blend is placed in boats and fired in a tube furnace at about 900° F. with nitrogen flowing through it for about one hour. The fired material is then allowed to cool in the nitrogen atmosphere and then dispersed in water and wet sieved through a 300–350 mesh screen. The wet sieved material is then washed in one percent by volume potassium cyanide solution. Several hot water washes are conducted until the filtrate has a low conductivity from 10 to 40 micromhos. The first water wash after decanting the potassium cyanide is highly concentrated with very fine material that needs to be removed if an efficient electrophotographic material is desired. Usually further hot water washes remove the finely divided and unactivated cadmium sulfide. Electrophotographic screens prepared from this material exhibit high image voltage when evaluated in an electrostatic copying machine. The initial image voltage generally ranges from about 700 to 1000 volts and the background voltage ranges from about −100 to about −200 giving a contrast voltage of from about 800 to 1200 volts. After as many as from about 15,000 to 50,000 cycles, the contrast voltage is in excess of 600 volts.

In FIG. 1 the particle size distribution of the material measured by the Coulter Counter is shown graphically. As is shown, the average particle size is about 3 micrometers, and less than 5% of the particles are over about 5 micrometers while greater than 20% are between about 1 and 2 micrometers.

EXAMPLE II

In similar procedure as in Example I, the cadmium selenide can be dispersed together during the co-precipitating of copper-cadmium sulfide and a satisfactory material can be produced.

EXAMPLE III

The material prepared by Example I and II are submitted to the ion exchange washing procedures where the surface of the cadmium sulfo-selenide is depleted of both anions and cationic species. This treatment enhances the electrical properties of the electrophotographic material and yields copies of high contrast when incorporated into an electrophotoconductive member 10 comprises an electrical insulating layer 12 overlying a layer 14 of electrophotoconductive material of this invention which overlies and is deposited on an electrically conductive base 16. The electrical insulating layer 12 must have a high electrical resistance, transparency and abrasion proof properties and has a thickness of from about 20 to 40 micrometers. For test purposes the thickness is about 25 micrometers. Suitable materials include polyester films and various other organic polymers and resins, various glasses and the like which have an electrical strength of about 100 volts per mil or higher and a transparency equivalent to window glass. Of the foregoing insulating layers polyester films are preferred. The layer of electrophotoconductive material 14 of this invention is usually in the range of thickness of from about 40 to about 60 micrometers. For test purposes it is generally about 50 micrometers in thickness. The electrically conductive layer 16 is generally a metallic material such as aluminum or copper. The thickness of the electrically conductive layer or member is determined by the mechanical characteristics of the element. For example, a drum is generally used and the thickness of the electrically conductive member or base is dependent upon the diameter of the drum.

Operation of the reproductive equipment containing electrophotoconductive elements for copying purposes are well known and are not detailed herein:

EXAMPLE IV

A sample is prepared as follows:

8.75 parts of copper containing cadmium sulfide
0.50 parts of anhydrous cadmium chloride
0.50 parts of cadmium selenide
0.25 parts of powdered sulfur are mixed in a blender for about 15 minutes. The blend is fired for about 1 hour at about 900° F. under a nitrogen atmosphere. The material is then wet sieved through 300–350 mesh screen and washed with 1–2% potassium cyanide solution. Thereafter, the material is water washed several times until the conductivity of wash water is below about 40 micromhos. The material is separated and dried at 120°±20° C. for about 16 hours.

This material when evaluated in an electrophotoconductive element exhibits excellent electrical properties.

EXAMPLE V

Following the procedure given in Example I five samples of photoconductive materials are prepared and tested in photoconductive member as described hereinafter. The copper and chloride levels are held constant thus in the formula, $Cd(S_xSe_{1-x})$: yCu•zCl, x is varied from 0.84 to 1.0 and y and z are held constant at 0.0005 and 0.001 respectively. The results of the tests are shown below:

TABLE I

| Sample | x | y | z | Image Voltage | Background Voltage | Contrast Voltage |
|---|---|---|---|---|---|---|
| 1 | 1.000 | 0.0005 | 0.001 | 660 | −120 | 780 |
| 2 | .979 | 0.0005 | 0.001 | 740 | −180 | 920 |
| 3 | .957 | 0.0005 | 0.001 | 700 | −100 | 800 |
| 4 | .936 | 0.0005 | 0.001 | 580 | −100 | 680 |
| 5 | .840 | 0.0005 | 0.001 | 400 | − 50 | 450 |

Figure 3:
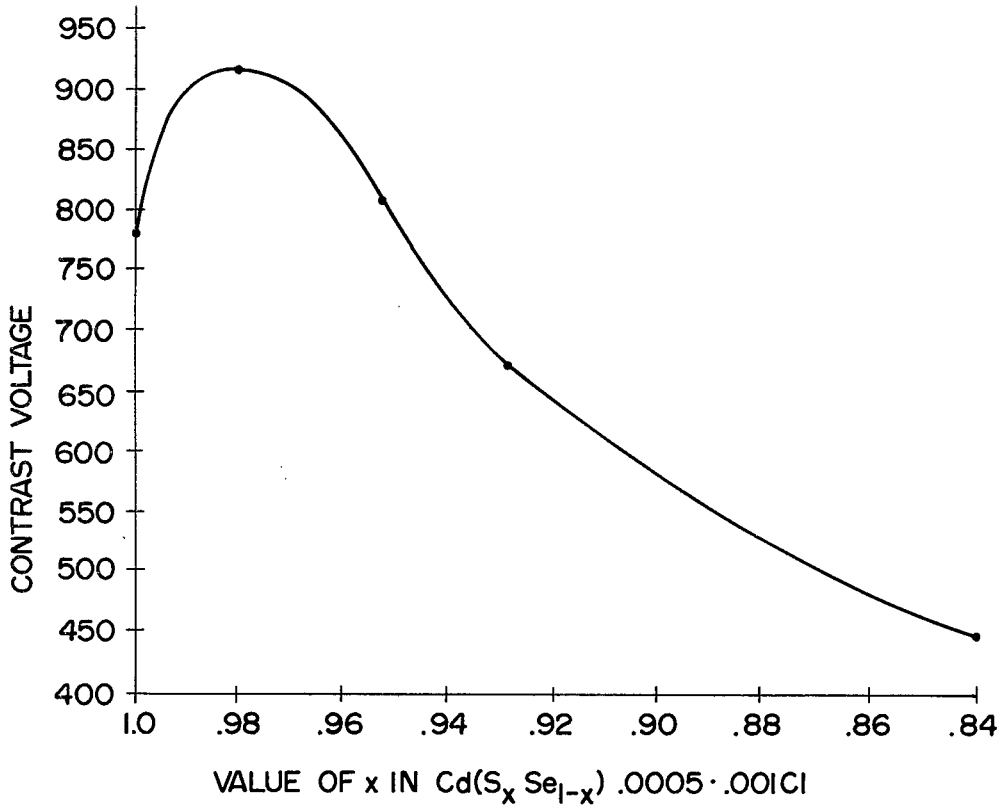
FIG. 3 is a graph illustrating the beneficial results obtained by controlling the ratio of S to Se.

The above results are illustrated graphically in FIG. 3 and show the beneficial effects from the combination of cadmium selenide and cadmium sulfide when x is within the range of from 0.95 to 0.98.

The above samples are tested by utilizing them in a photosensitive member which is described in Example III.

While there has been shown and described what are at present considered the preferred embodiments of the invention, it will be obvious to those skilled in the art that various changes and modifications may be made therein without departing from the scope of the invention as defined by the appended claims.

What is claimed is:

1. An electrophotographic member consisting essentially of:

(a) an electrically conductive base;

(b) a layer of a particulate electrophotoconductive material having a thickness of from about 40 to about 60 micrometers overlying said base, said material consisting essentially of an activated cadmium sulfo-selenide having the molecular formula:

$$Cd(S_xSe_{1-x}):yCu\bullet ZCl$$

wherein x is from about 0.95 to about 0.998, y is from about 0.0001 to about 0.001, and z is from about 0.001 to about 0.0015 and having an average particle size of up to about 3.2 micrometers and about 95% of the particles in the 1 to 5 micrometer range as measured by the Coulter Counter method; and (c) an electrically insulative optically transparent layer overlying said electrophotoconductive layer having a thickness of from about 20 to about 40 micrometers, said member exhibiting initial contrast voltage of at least about 800 volts.

* * * * *